US006914515B2

(12) United States Patent
Miura et al.

(10) Patent No.: US 6,914,515 B2
(45) Date of Patent: Jul. 5, 2005

(54) MOTOR-DRIVEN SLIDE TYPE VARIABLE RESISTOR AND METHOD OF MANUFACTURING THE RESISTOR

(75) Inventors: Seiki Miura, Okayama (JP); Yukio Hashimoto, Okayama (JP); Kenji Kataoka, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 36 days.

(21) Appl. No.: 10/309,872

(22) Filed: Dec. 4, 2002

(65) Prior Publication Data

US 2003/0117256 A1 Jun. 26, 2003

(30) Foreign Application Priority Data

Dec. 5, 2001 (JP) ..... 2001-371273

(51) Int. Cl.[7] ..... H01C 10/14

(52) U.S. Cl. ..... 338/116; 338/153; 338/176

(58) Field of Search ..... 338/116, 153, 338/176

(56) References Cited

FOREIGN PATENT DOCUMENTS

| | | | |
|---|---|---|---|
| GB | 2308507 | * | 6/1997 |
| JP | 11-87110 | * | 3/1999 |
| JP | 11-144917 | * | 5/1999 |

* cited by examiner

*Primary Examiner*—Karl D. Easthom
(74) *Attorney, Agent, or Firm*—RatnerPrestia

(57) ABSTRACT

In a motor-driven slide type variable resistor, the tensioning of a toothed loop belt joined to an operating lever is adjusted with a pin adjusted to change the distance between a toothed pulley and a follower pulley in order to adjust a traveling speed of the operating lever. The variable resistor has little variations of the traveling speed of the operating lever and is accurate

9 Claims, 5 Drawing Sheets

MOTOR-DRIVEN SLIDE TYPE VARIABLE RESISTOR AND METHOD OF MANUFACTURING THE RESISTOR

FIELD OF THE INVENTION

The present invention relates to a motor driven slide type variable resistor operating with a motor and hand.

BACKGROUND OF THE INVENTION

FIG. 8 is a perspective view of a conventional motor-driven slide type variable resistor, and FIG. 9 is a front cross sectional view of a follower-pulley mounter, an essential portion of the resistor. A frame 1 is made of a long, L-shaped metal strip having a linear slit 1B provided lengthwise in the center region of a planar side 1C thereof. A slide type variable resistor unit 2 is joined by screws 1A to the lower side of the frame 1, so that an operating lever 7 extends upward through the slit 1B of the frame 1. With a rotary shaft 3A being arranged vertically, a motor 3 is fixedly mounted to one lengthwise end of the frame 1 by motor retaining screws 3B which extend through corresponding screw slots 3C. A toothed pulley 4 is mounted to the upper end of the rotary shaft 3A. The frame 1 has a columnar pin 10 anchored by a retainer screw 11 to the other lengthwise end thereof, and a follower pulley 5 is rotatably mounted to the pin 10. A toothed belt 6 of an annular shape is mounted under tension between the toothed pulley 4 and the follower pulley 5. The operating lever 7 of the variable resistor unit 2 is fixedly joined by a resin joint 8 to an intermediate portion of the belt 6.

The slide type variable resistor unit 2 can operate manually. As shown in FIG. 9, a slider 13 is supported at the bottom with a resilient contact 12 and is accommodated for linear movement along the lengthwise direction in a long, box-like housing which includes a long bottom-opened metal case 14 and a resistor circuit board 15 mounted to the lower side of the metal case 14 to close the bottom opening of the metal case 14.

The slider 13 may operate with the motor 3 driving the toothed belt 6 and with a hand holding a knob 9 mounted to the upper end of the operating lever 7.

For example, plural conventional motor-driven slide type variable resistors may be mounted in a row in an electronic apparatus, such as an audio mixer. If respective operating levers 7 driven by the motors 3 in the resistors travel at different speeds from each other, the variable resistor units 2 may be declined in the performance at combination. Therefore, the operating levers 7 preferably travel at identical speeds.

A variation of tensioning of the toothed belts 6 resulting from variations in their size and a change in the number of revolutions of the motor 3 can be compensated by the following procedure. The motor retaining screws 3B are loosened, and the motor 3 is then re-positioned along the screw slots 3C in the frame 1 to tension the toothed belt 6 at an optimum. Then, the motor 3 is tightened again. This, however, consume a considerable length of time.

SUMMARY OF THE INVENTION

A variable resistor includes: a frame having a linear slit provided therein; a slide type variable resistor unit including an operating lever extending through the linear slit of the frame; a motor mounted to the frame a first direction parallel to the linear slit from the linear slit; a first pulley mounted to a rotary shaft of the motor; a pulley mounter mounted to the frame in a second direction opposite to the first direction from the linear slit, the pulley mounter rotatable about a first axis in relation to the frame; a second pulley mounted to the pulley mounter, the second pulley being rotatable about a second axis which is not aligned with the first axis; and a loop belt mounted between the first and second pulleys, the belt being joined to the operating lever.

The variable resistor allows the tensioning of the belt to be easily adjusted in order to stabilize a traveling speed of the operating lever.

DETAIL DESCRIPTION OF THE PREFERRED EMBODIMENTS

An exemplary embodiment of the present invention will be described referring to FIGS. 1 to 7. Like components are denoted by like numerals as those of the prior art and will be explained in no more detail.

Figure 1:
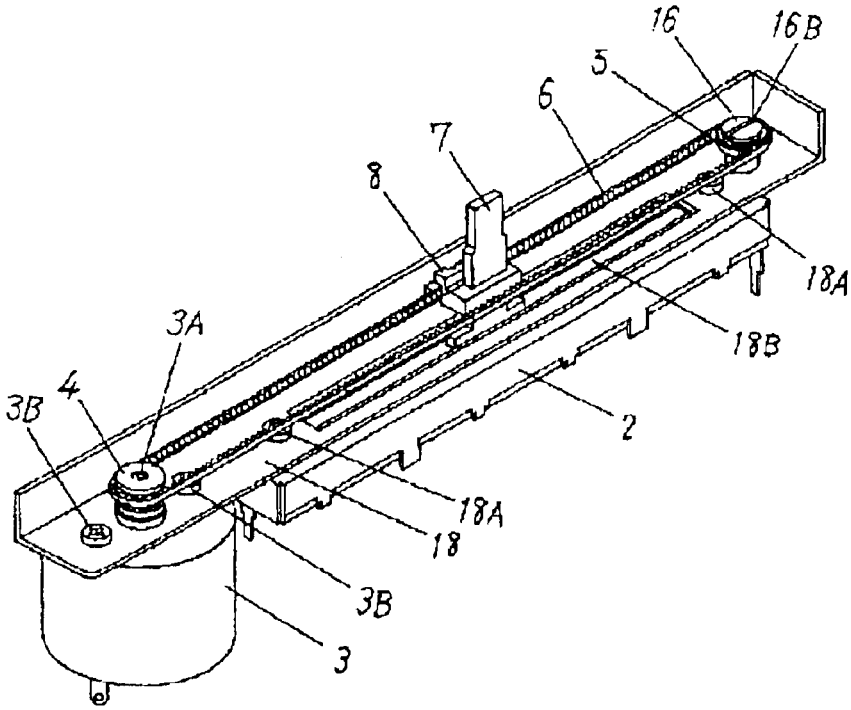
FIG. 1 is a perspective view of a motor-driven slide type variable resistor according to an exemplary embodiment of the present invention.
Figure 2:
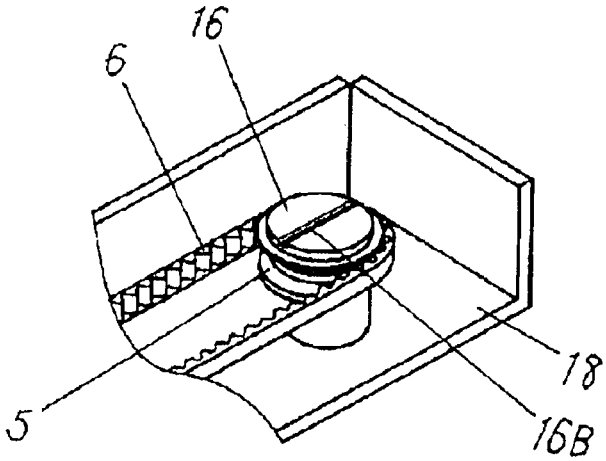
FIG. 2 is a perspective view of a follower pulley mounter of the variable resistor according to the embodiment.

FIG. 1 is a perspective view of a motor-driven slide type variable resistor according to the embodiment. FIG. 2 is a perspective view of a follower pulley mounter, an essential portion of the resistor. A frame 18 is made of a long, L-shaped metal strip having a linear slit 18B provided lengthwise in the center region of a planar side thereof. A slide type variable resistor unit 2 is joined by screws 18A to the lower side of the planer side of the frame 18. With a rotary shaft 3A being arranged vertically, a motor 3 is fixedly mounted to one lengthwise end of the frame 18 by motor retaining screws 3B. A toothed pulley 4 is mounted to the upper end of the rotary shaft 3A. The frame 18 has a columnar pin 16 anchored as a pulley mounter with a retainer screw 11 (described later) to the other lengthwise end thereof A follower pulley 5 is rotatably mounted to the pin 16 to face the toothed pulley 4. A toothed belt 6 of a loop shape is mounted under tension between the toothed pulley 4 and the follower pulley 5. An operating lever 7 of the slide type variable resistor unit 2 is fixedly joined with a resin joint 8 to an intermediate portion of the belt 6.

The slide type variable resistor unit 2 can operate with a hand. The variable resistor unit 2 has an operating lever 7 joined by two screws 18A to the lower side of the frame 18, so that the lever extends outward through the linear slit 18B A in the planer side of the frame 18 and can be slid linearly along the frame 18.

The variable resistor unit 2 has a construction substantially identical to a conventional variable resistor unit and will not be described.

The operating lever 7 can manually be slid with a knob 9 (not shown) moving for controlling the variable resistor unit 2. Alternatively, the operating lever 7 can operate with the motor 3 on the frame 18. The motor rotates the toothed pulley 4 on a rotary shaft 3A and thus drives the toothed belt 6 joined by the joiner 8 to the operating lever 7.

Figure 3:
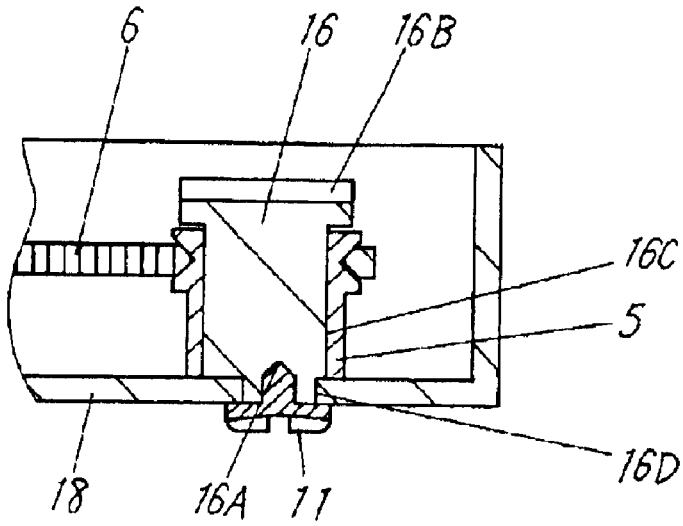
FIG. 3 is a front cross sectional view of the follower pulley mounter of the variable resistor according to the embodiment.

As shown in FIG. 3, the columnar pin 16 having the follower pulley 5 rotatably mounted thereto has a female thread 16A provided in the bottom thereof and a slot 16B provided in the top thereof for positioning adjustment.

The retaining axis of the pin 16 fixedly joined by the retainer screw 11 to the frame 18 is not aligned with the rotating axis of the follower pulley 5 rotatably mounted to the pin 16.

A procedure of adjusting the tensioning of the toothed belt 6 mounted between the toothed pulley 4 and the follower pulley 5 will be described.

Figure 4:
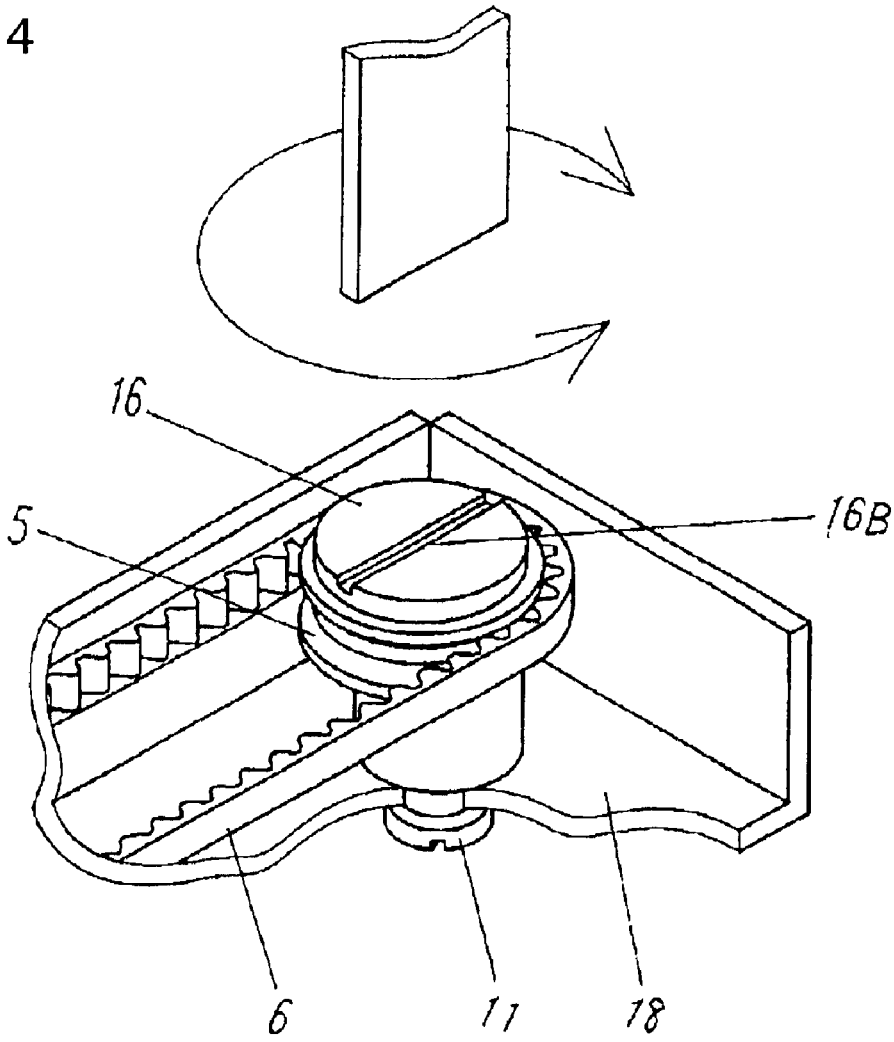
FIG. 4 is a perspective view of a pin turned for adjustment in the variable resistor of the embodiment.

As shown in FIG. 4, the pin 16 is adjustably joined from below with the retainer screw 11 to the bottom of the frame 18. For adjustment, the pin 16 can be turned in relation to the frame 18 with a slotted screwdriver inserted into the slot 16B in the top of the pin 16. Accordingly, the follower pulley 5 moves circularly about the retaining axis of the pin 16 since the rotating axis of the pulley is not aligned with the retaining axis of the pin 16. This operation changes the distance between the toothed pulley 4 and the follower pulley 5.

In other words, the tensioning of the toothed belt 6 mounted between the toothed pulley 4 and the follower pulley 5 can easily be adjusted without a specific tool to determine the traveling speed of the operating lever 7.

After the tensioning has been set the traveling speed to a desired one, the retainer screw 11 is tightened to anchor the pin 16 to the lower side of the frame 18.

Figure 5:
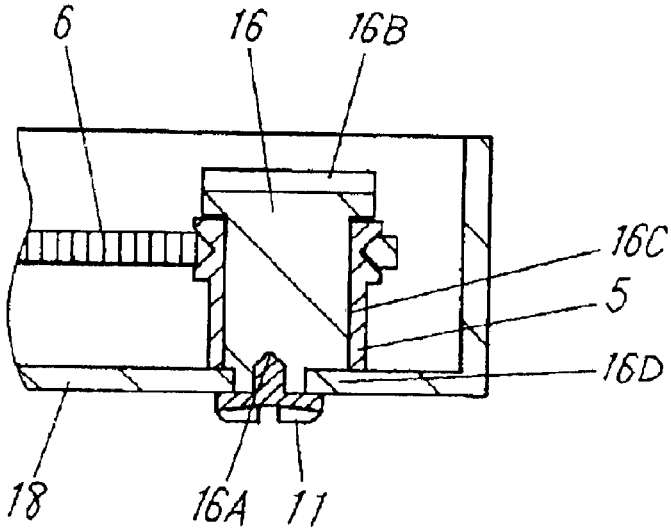
FIG. 5 is a cross sectional view of a toothed belt tensioned in the variable resistor according to the embodiment.

The pin 16 shown in FIG. 3 is located at a position for holding the toothed belt 6 with maximum looseness. The pin 16 shown in FIG. 5 is located at a position for tensioning the toothed belt 6 most. The toothed belt 6 is preferably tensioned between the two positions.

The follower pulley 5 is mounted to a large diameter portion 16C of the pin 16 having a round cross section. The tensioning of the toothed belt 6 can be adjusted within a wider range if the portion 16C is large in the diameter enough to increase the distance from its center axis to the center axis of a small diameter portion 16D of the pin 16 which is anchored with the retainer screw 11 to the lower side of the frame 18.

Figure 6:
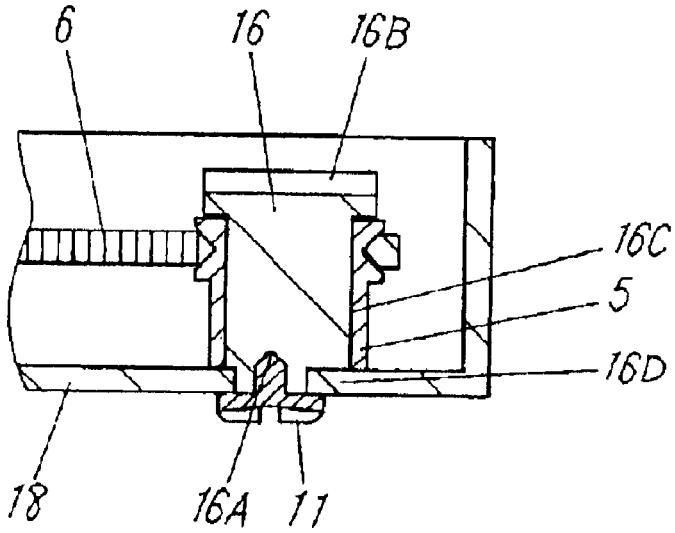
FIG. 6 is a cross sectional view of another variable resistor according to the embodiment.

Referring to FIG. 6, a procedure of adjusting the tensioning of the toothed belt 6 mounted between the toothed pulley 4 and the follower pulley 5 in another slide type variable resistor will be explained. The pin 16 is anchored to the frame 18 with a spring washer 17 between the frame 18 and the retainer screw 19.

The tension strength of the toothed belt 6 may be small in mN. The spring washer 17 between the frame 18 and the retainer screw 19 hence allows the pin 16 to turn for adjusting the tensioning of the toothed belt 6 while remaining tightened by the retainer screw 19 not to be affected by the tension strength. This allows the tensioning to be adjusted more accuracy.

Figure 7:
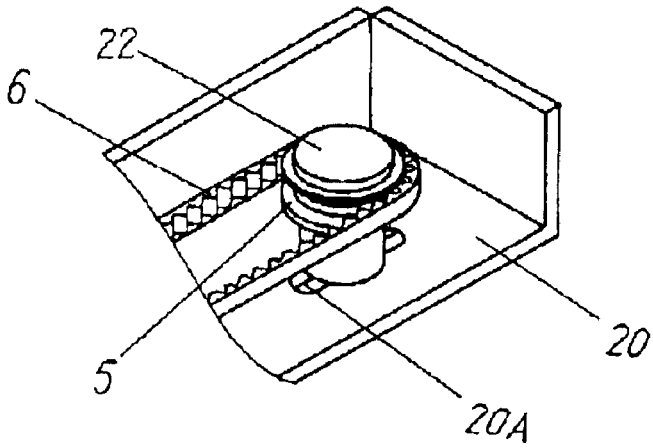
FIG. 7 is a perspective view of a follower pulley mounter of a further variable resistor according to the embodiment.
Figure 8:
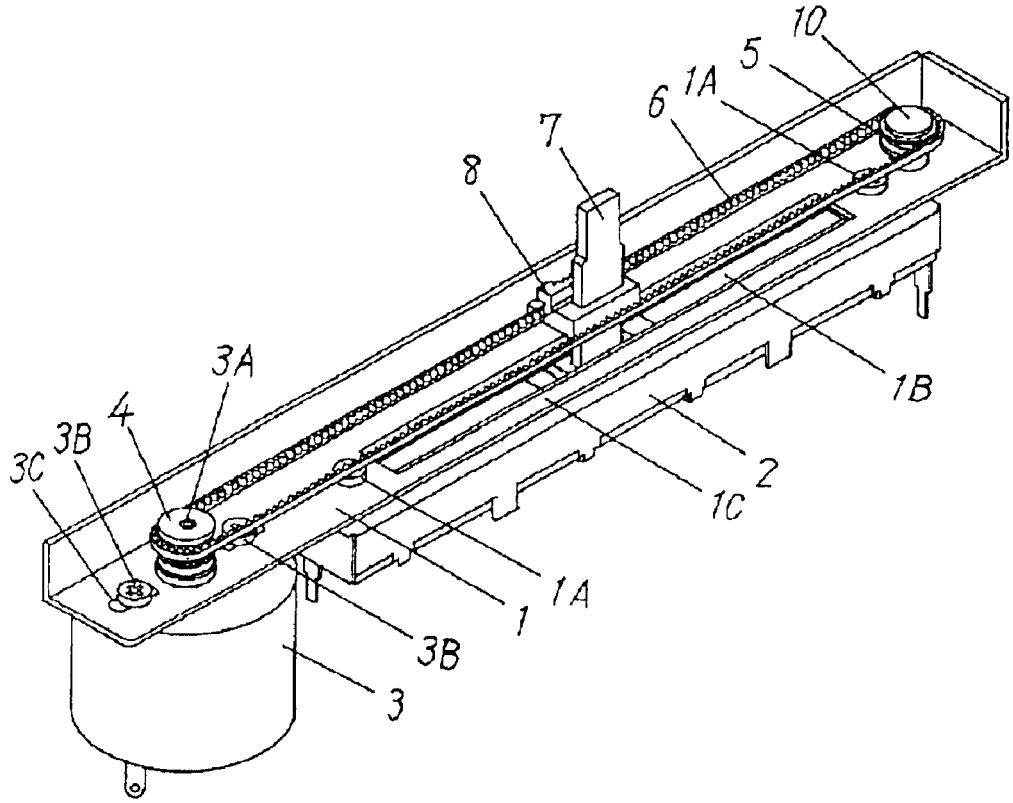
FIG. 8 is a perspective view of a conventional motor-driven slide type variable resistor.
Figure 9:
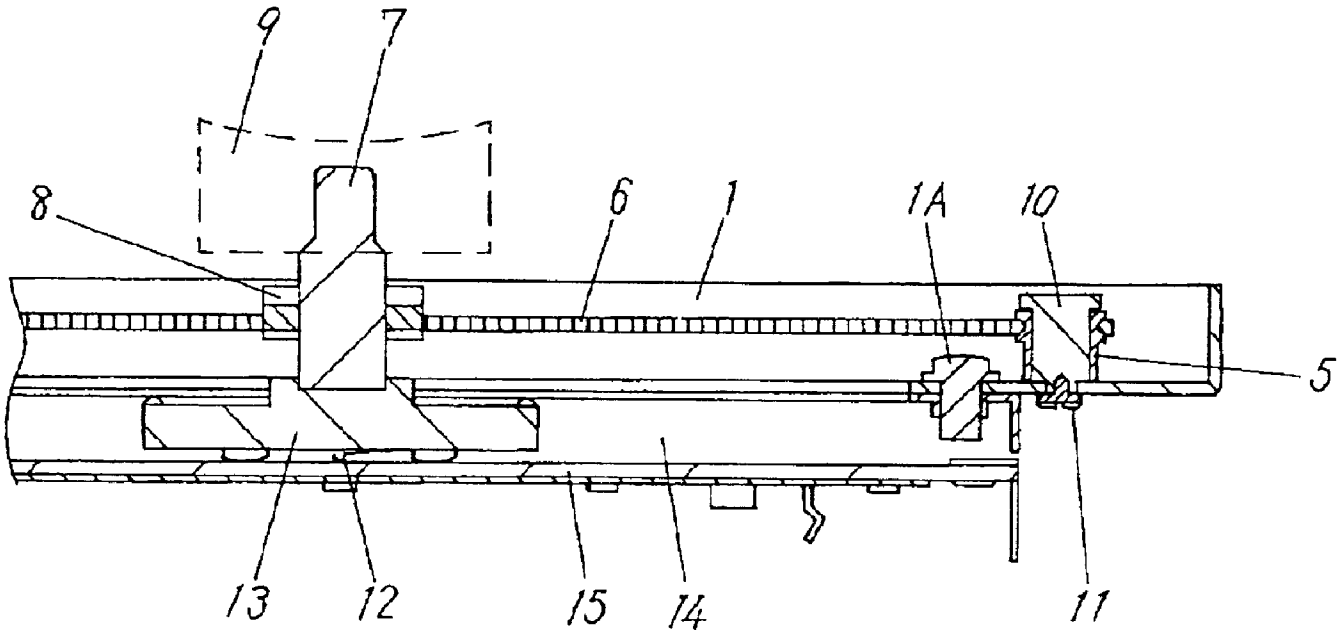
FIG. 9 is a front cross sectional view of a follower pulley mounter of the conventional variable resistor.

As shown in FIG. 7, a slot 20A may be provided in a frame 20 for accepting a columnar pin 22. The slot is arranged of an oblong shape extending lengthwise along the slit of the frame 20. This arrangement allows the pin 22 to be positioned preferably along the lengthwise direction within the oblong slot 20A before anchored to the frame 20. This allows the tensioning of the toothed belt 6 between the toothed pulley 4 and the follower pulley 5 to be carried out easily to determine the traveling speed of the operating lever 7.

What is claimed is:

1. A variable resistor comprising:

a frame;

a slide type variable resistor unit coupled to said frame and including an operating lever;

a motor mounted to said frame;

a first pulley mounted to a rotary shaft of said motor;

a pulley mounter mounted to said frame, said pulley mounter rotatable about a first axis In relation to said frame;

a second pulley coupled to said pulley mounter, said second pulley being rotatable in relation to said pulley mounter about a second axis away from said first axis, wherein rotation of said pulley mounter about said first axis moves said second pulley along an arc; and a loop belt mounted between said first and second pulleys, said belt being coupled to said operating lever to move said operating lever.

2. The variable resistor according to claim 1, wherein said first and second pulleys and said belt are of a toothed type.

3. The variable resistor according to claim 1, wherein said pulley mounter has a slot provided in a top thereof.

4. The variable resistor according to claim 1, wherein said frame has an oblong slot provided therein, and said pulley mounter is mounted through said oblong slot and is movable along said oblong slot.

5. The variable resistor according to claim 1, wherein said frame has a linear slit provided therein through which said operation lever extending.

6. The variable resistor according to claim 1, wherein said pulley mounter rotates in order to change a length of a path along which said belt moves.

7. The variable resistor according to claim 4, wherein said frame has a linear slit provided therein through which said operation lever extending.

8. The variable resistor according to claim 7, wherein said linear slit is parallel to said oblong slot.

9. The variable resistor according to claim 1, wherein the arc has a center coinciding with said first axis.

* * * * *